US011346038B2

(12) United States Patent
Kim et al.

(10) Patent No.: US 11,346,038 B2
(45) Date of Patent: May 31, 2022

(54) WASHING MACHINE

(71) Applicant: LG Electronics Inc., Seoul (KR)

(72) Inventors: Hyundong Kim, Seoul (KR); Kyungchul Woo, Seoul (KR); Junghoon Lee, Seoul (KR); Myunghun Im, Seoul (KR); Hwanjin Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 110 days.

(21) Appl. No.: 16/617,343

(22) PCT Filed: May 10, 2018

(86) PCT No.: PCT/KR2018/005349
§ 371 (c)(1),
(2) Date: Nov. 26, 2019

(87) PCT Pub. No.: WO2018/208089
PCT Pub. Date: Nov. 15, 2018

(65) Prior Publication Data

US 2020/0217005 A1 Jul. 9, 2020

(30) Foreign Application Priority Data

May 10, 2017 (KR) ..... 10-2017-0058276

(51) Int. Cl.
*D06F 39/08* (2006.01)
*D06F 23/04* (2006.01)
*D06F 39/02* (2006.01)

(52) U.S. Cl.
CPC ..... *D06F 39/083* (2013.01); *D06F 23/04* (2013.01); *D06F 39/02* (2013.01); *D06F 39/08* (2013.01); *D06F 39/088* (2013.01)

(58) Field of Classification Search
None
See application file for complete search history.

(56) References Cited

U.S. PATENT DOCUMENTS 4,464,914 A * 8/1984 Torita ..... D06F 39/088 68/23.5
5,307,651 A * 5/1994 Felzer ..... D06F 35/006 68/23.5
5,823,018 A * 10/1998 Lee ..... D06F 39/083 68/23.5

FOREIGN PATENT DOCUMENTS

KR 10-0212427 7/1997
KR 10-2003-0040660 5/2003
(Continued)

OTHER PUBLICATIONS

PCT International Search Report in PCT Appln. No. PCT/KR2018/005349, dated Sep. 18, 2018, 3 pages.
(Continued)

*Primary Examiner* — Cristi J Tate-Sims
(74) *Attorney, Agent, or Firm* — Fish & Richardson P.C.

(57) ABSTRACT

A washing machine includes an outer tub which contains water and has an upper side opened; an inner tub; an outer tub cover which is provided in an upper side of the outer tub and has an opening that is formed so that laundry is loaded into the inner tub; a circulation pipe which guides water discharged from the outer tub; a pump which transfers water along the circulation pipe; and a spray mechanism which is provided in the outer tub cover and sprays the water guided through the circulation pipe into the inner tub, wherein the spray mechanism includes: a guide pipe which forms a guide flow path for guiding the water supplied from the circulation pipe along a circumference of the opening; and a plurality of nozzles which are disposed along the guide flow path and spray the water supplied through the guide pipe into the inner tub.

15 Claims, 17 Drawing Sheets

(56) References Cited

FOREIGN PATENT DOCUMENTS

| | | |
|---|---|---|
| KR | 10-2010-0004719 | 11/2014 |
| KR | 10-2010-0059370 | 11/2015 |
| KR | 10-1708665 | 2/2017 |

OTHER PUBLICATIONS

KR Office Action in Korean Appln. No. 10-2017-0058276, dated Mar. 15, 2021, 18 pages (with English translation).

* cited by examiner

WASHING MACHINE

CROSS-REFERENCE TO RELATED APPLICATIONS

This application is a National Stage application under 35 U.S.C. § 371 of International Application No. PCT/KR2018/005349, filed on May 10, 2018, which claims the benefit of Korean Application No. 10-2017-0058276, filed on May 10, 2017. The disclosures of the prior applications are incorporated by reference in their entirety.

TECHNICAL FIELD

The present invention relates to a washing machine.

BACKGROUND ART

In general, a washing machine is provided with an outer tub in a casing and an inner tub which accommodates laundry (or "cloth") and is rotatably provided in the outer tub, and further includes a dispenser for supplying water into the inner tub (or outer tub). The dispenser includes a drawer containing detergent, and water supplied to the dispenser is supplied into the inner tub together with the detergent while passing through the drawer.

After the water is supplied together with the detergent, a pulsator and/or the inner tub rotatably provided in the inner tub is rotated, so that the contaminations of the laundry is removed by emulsification of the detergent, the water flow action generated by the rotation of the inner tub or the pulsator, and the physical impact applied from the pulsator.

However, the conventional washing machine has a narrow range in which detergent water is discharged through the dispenser, so that the range in which the water supplied through the dispenser directly touches the laundry is also limited. Therefore, it can be seen that the laundry is sufficiently wetted only when the water level in the inner tub is sufficiently raised to the extent that the laundry is submerged as the water is continuously supplied through the dispenser. However, even in this case, typically, all of the detergent is discharged from the drawer at the beginning of the water supply, and then, only water is supplied without supply of detergent. Therefore, even if the water supply is completed and all the laundry in the inner tub is submerged, there is a problem in that detergent does not penetrate smoothly to the laundry positioned in the upper side among the loaded laundry.

In addition, recently, in some cases, a circulation system for circulating water discharged from the outer tub through a circulation pipe and supplying the water again to the inner tub is applied. However, even in this case, as the circulation pipe is connected to a single nozzle, there is a limit on evenly washing the laundry.

DISCLOSURE

Technical Problem

A first object of the present invention is to provide a washing machine for evenly applying detergent to a laundry loaded in an inner tub, and in particular, to provide a control method of a washing machine for sufficiently applying detergent to the upper ones among the laundry loaded in the inner tub.

A second object of the present invention is to provide a washing machine that can quickly apply detergent to the laundry loaded in the inner tub.

A third object of the present invention is to provide a washing machine that can shorten the overall time required for washing, by shortening or excluding a process required for cloth soaking that applies the detergent to the laundry.

A fourth object of the present invention is to provide a washing machine in which a flow path is formed along the circumference of an opening provided in the outer tub cover, and the circulation water (i.e., the water discharged from the outer tub and circulated by the pump) supplied to the flow path is sprayed into the inner tub simultaneously through a plurality of nozzles.

Technical Solution

In a washing machine of the present invention, an inner tub disposed in an outer tub is rotated around an axis substantially vertical. An outer tub cover is provided above the outer tub. The outer tub cover is provided with an opening so that laundry is loaded into the inner tub.

In addition, the washing machine includes a circulation pipe which guides water discharged from the outer tub, a pump which transfers water along the circulation pipe, and a spray mechanism which is provided in the outer tub cover and sprays the water guided through the circulation pipe into the inner tub.

The spray mechanism includes: a guide pipe which forms a guide flow path for guiding the water supplied from the circulation pipe along a circumference of the opening, and a plurality of nozzles which are disposed along the guide flow path and spray the water supplied through the guide pipe into the inner tub.

The guide pipe includes an outer diameter portion which is extended along an upper end of the outer tub cover that defines the opening, and an inner diameter portion which is radially spaced inwardly from the outer circumference portion, and is extended in parallel with the outer circumference portion.

The inner diameter portion is provided with a plurality of nozzle communication ports for supplying the water guided along the guide flow path to the plurality of nozzles respectively.

The nozzle includes a collision surface extended from the inner diameter portion.

The collision surface which is extended to an outlet of the nozzle opened toward an inner side of the inner tub, and is inclined so that the water discharged through the nozzle communication port is bent downward.

The outer tub cover includes: a cover ring having a ring shape which is coupled to an upper end of the outer tub; a rim which is extended along an inner diameter of the cover ring and defines at least a portion of the opening; and a support rib which is protruded inwardly from the rim in a radial direction, and supports the guide pipe from below.

The guide pipe has a first end which communicates with the circulation pipe. A second end which is progressed and reached along the guide flow path from the first end is blocked.

Alternatively, according to an embodiment, the guide flow path may be formed in an annular form.

The spray mechanism includes a guide pipe port which is protruded outward from the guide pipe in a radial direction, and flow-path connects the circulation pipe and the guide pipe. The circulation pipe is connected to the guide pipe port through the outer tub cover.

The outer tub cover includes: a cover ring having a ring shape which is coupled to an upper end of the outer tub, a connection port which is protruded outward from the cover ring in a radial direction, and communicates an inside and an outside of the cover ring.

The circulation pipe is connected to the connection port in the outside of the cover ring.

The spray mechanism further includes a connection pipe for connecting the guide pipe and the connection port in the inside of the cover ring.

The outer tub cover includes: a cover ring having a ring shape which is coupled to an upper end of the outer tub, a connection port which is protruded outward from the cover ring in a radial direction, and communicates an inside and an outside of the cover ring.

The spray mechanism further includes a guide pipe port which is protruded outward from the guide pipe in a radial direction, and is connected to the connection port.

The spray mechanism further includes s a plurality of nozzle connection pipes which are provided to correspond to the plurality of nozzles, and respectively extended inward along a radial direction from the guide pipe to guide the water to a corresponding nozzle.

Each of the nozzle connection pipes is disposed in a bottom surface of the outer tub cover.

The nozzle connection pipe is gradually deflected in a circumferential direction as it progresses toward the nozzle from the guide pipe.

The outer tub cover includes a lower rim which is protruded downward from a circumference of the opening, and extended along the circumference of the opening, and the nozzle connection pipe is provided with a rim insertion hole into which the lower rim is inserted.

The pump is a variable speed pump.

Advantageous Effects

The control method of the washing machine according to the present invention has an effect of uniformly washing laundry by applying detergent evenly to the laundry loaded in the inner tub. In particular, by sufficiently applying detergent to the upper ones among the laundry loaded in the inner tub, there is an effect that it is possible to evenly wash both the laundry positioned in the lower portion of the inner tub and the laundry positioned in the upper portion of the inner tub.

Second, the process required for cloth soaking is shortened or excluded by quickly applying detergent to the laundry loaded in the inner tub, so that there is an effect of reducing the overall time required for washing, and reducing the power consumption.

Third, a flow path is formed along the circumference of an opening provided in the outer tub cover, and there is an effect that the circulation water (i.e., the water discharged from the outer tub and circulated by the pump) supplied to the flow path is sprayed into the inner tub simultaneously through a plurality of nozzles.

MODE FOR INVENTION

Figure 1:
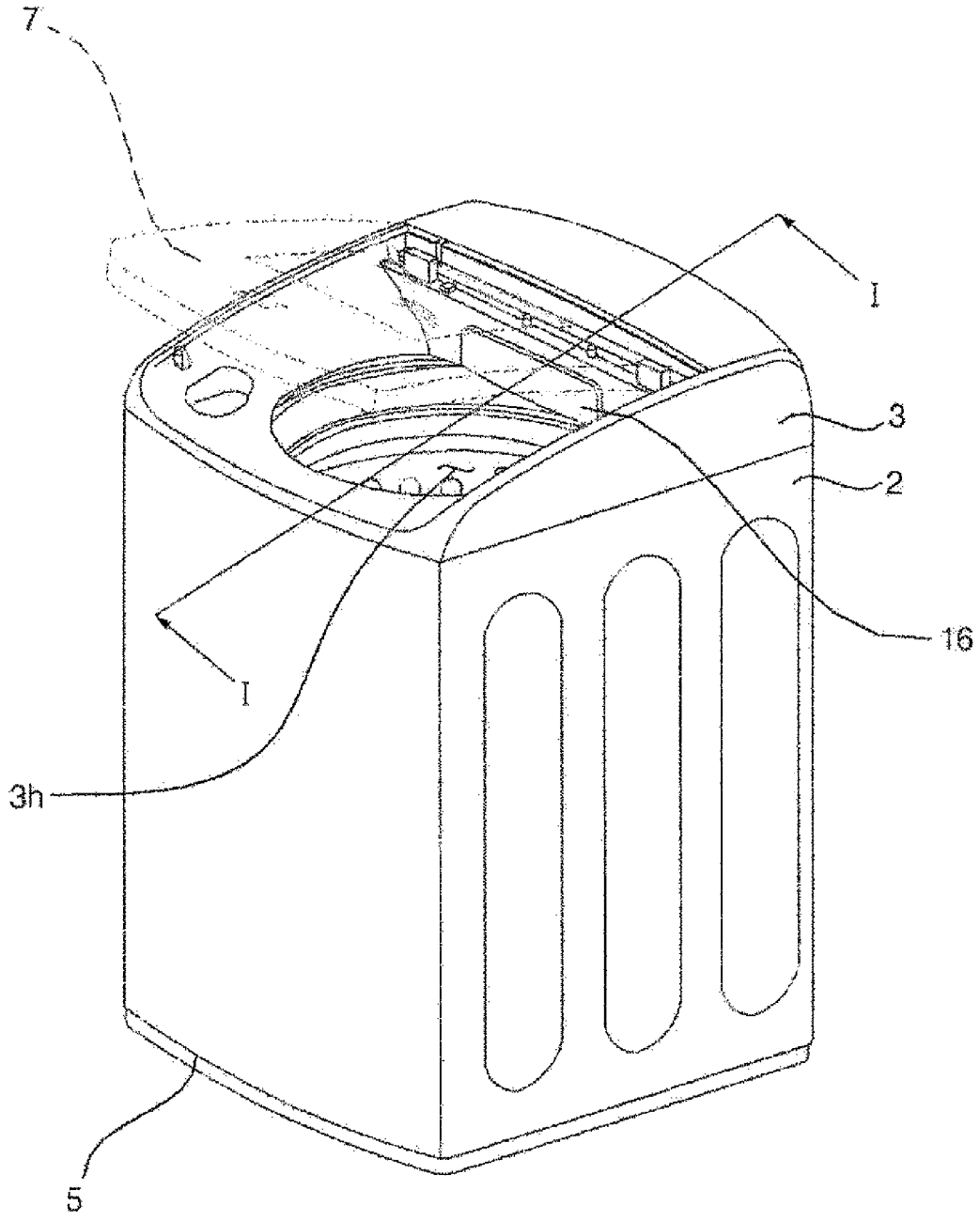
FIG. 1 is a perspective view of a washing machine according to an embodiment of the present invention.
Figure 2:
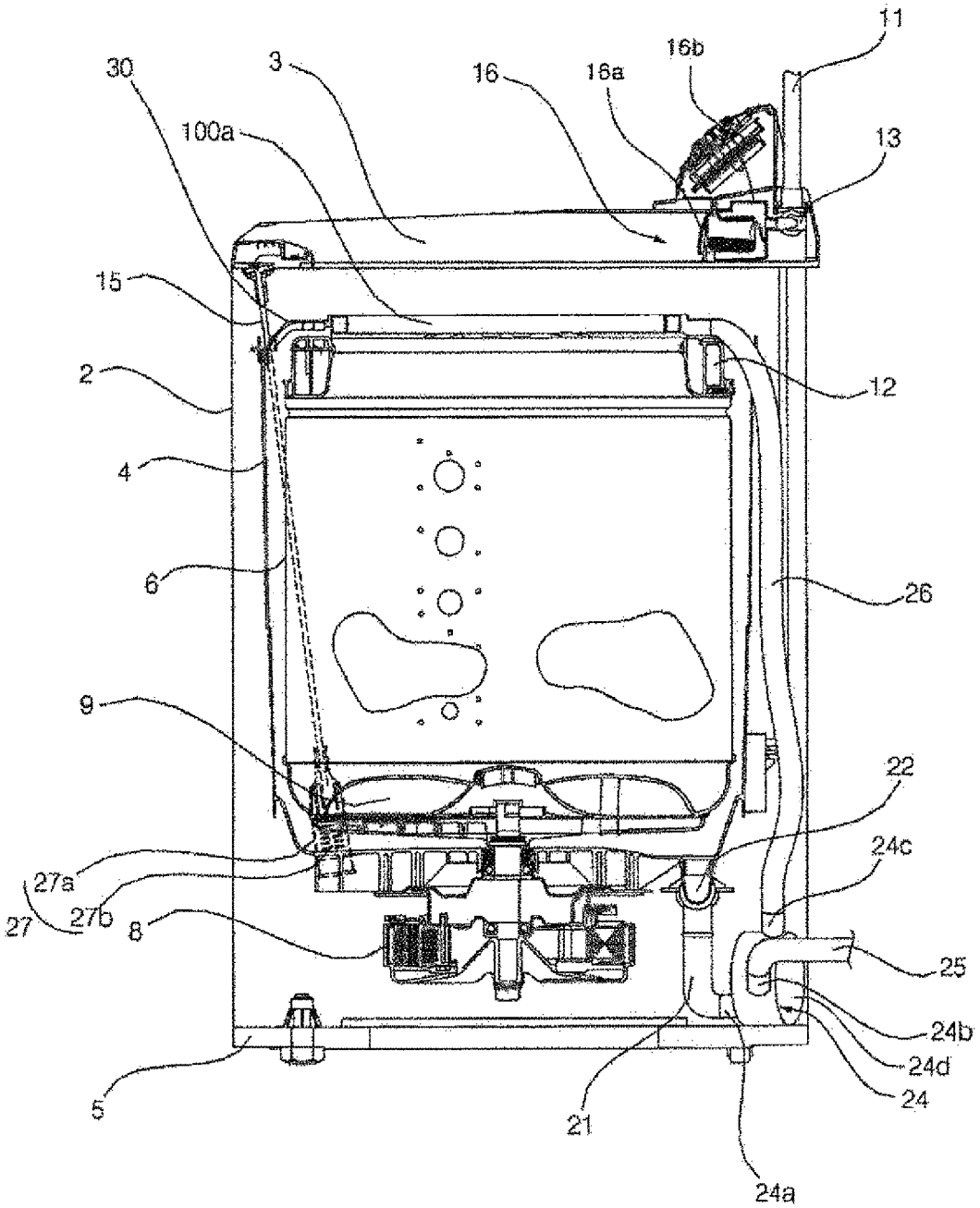
FIG. 2 is a cross-sectional side view taken along the line I-I of FIG. 1.
Figure 3:
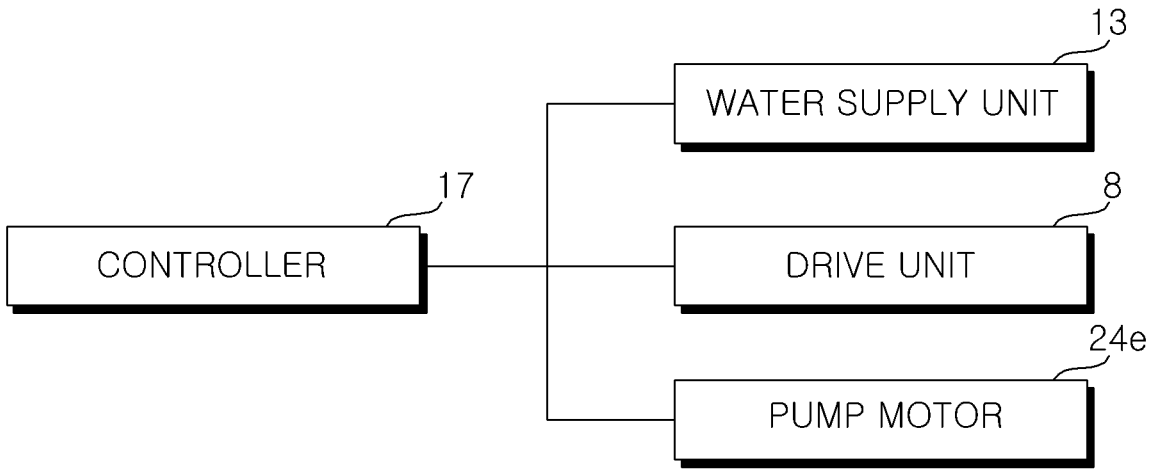
FIG. 3 is a block diagram showing a control relationship between major components of a washing machine according to an embodiment of the present invention.
Figure 4:
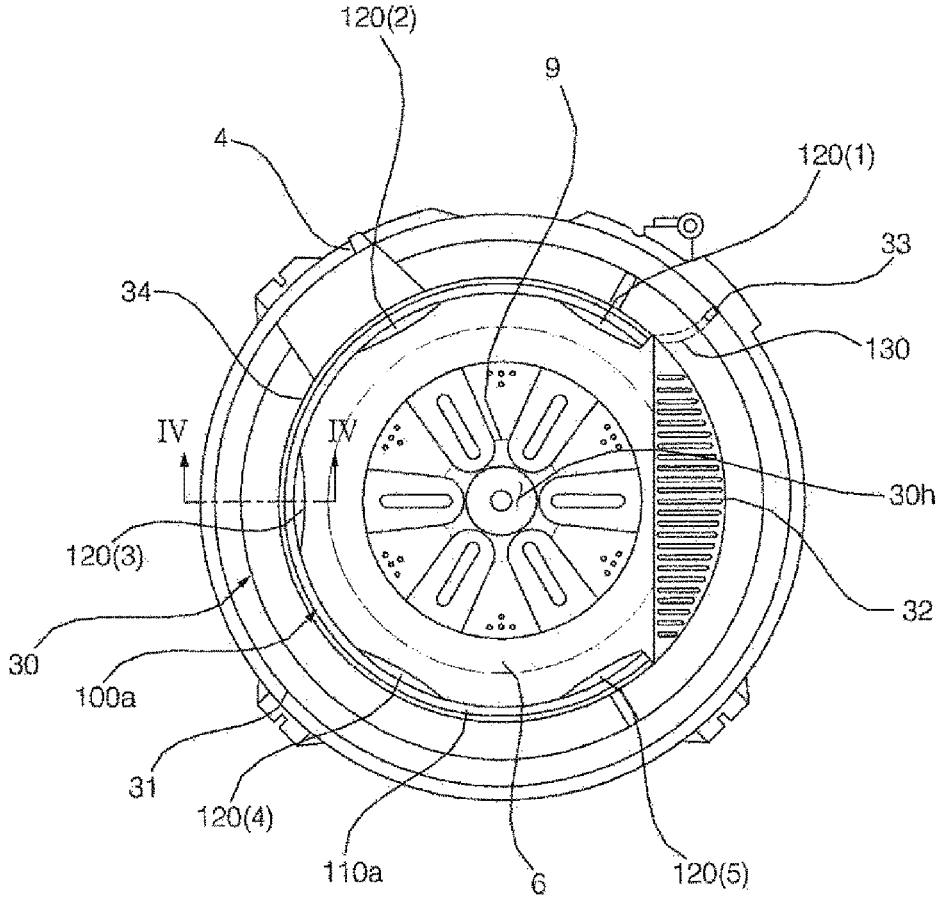
FIG. 4 is a partial view of a washing machine according to an embodiment of the present invention.
Figure 5:
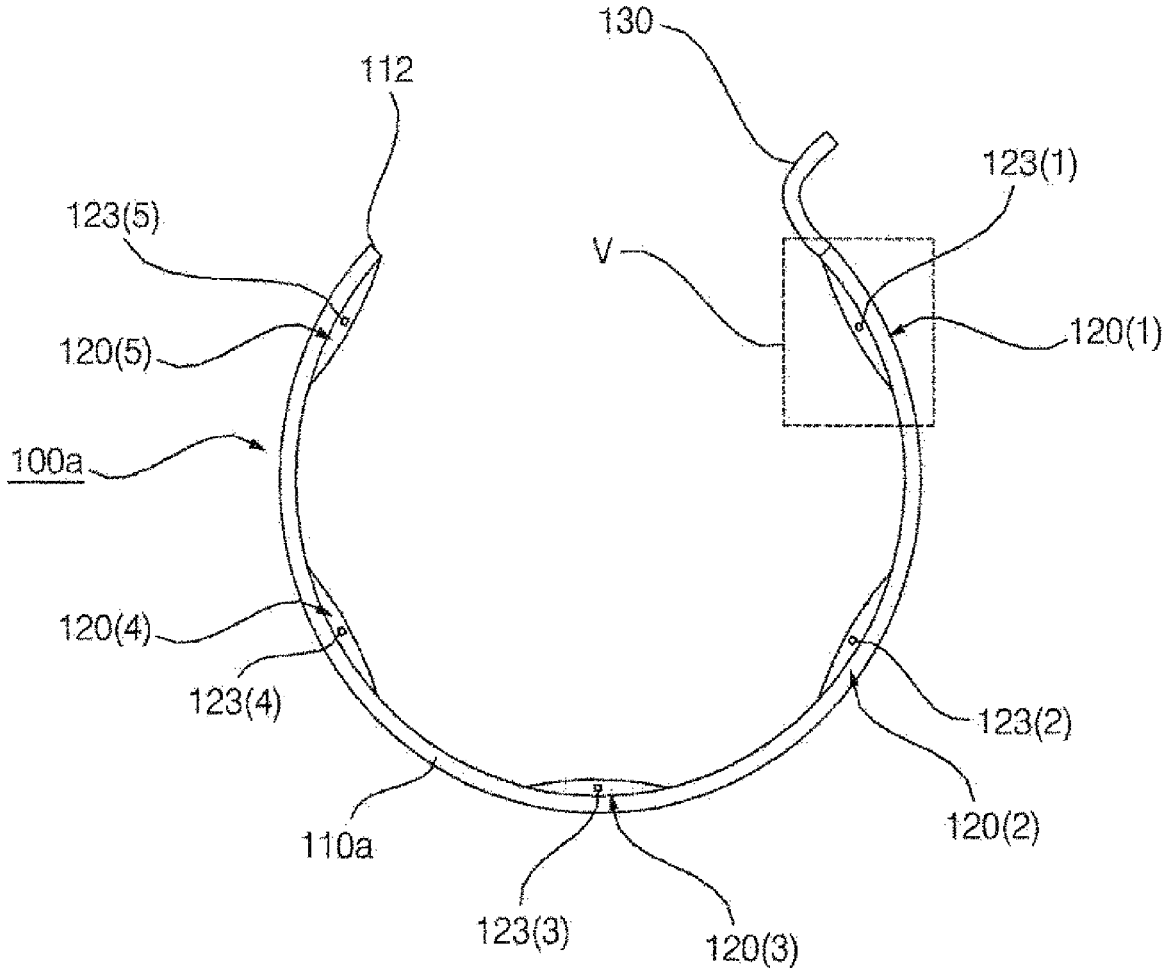
FIG. 5 shows a spray mechanism shown in FIG. 4.
Figure 6:
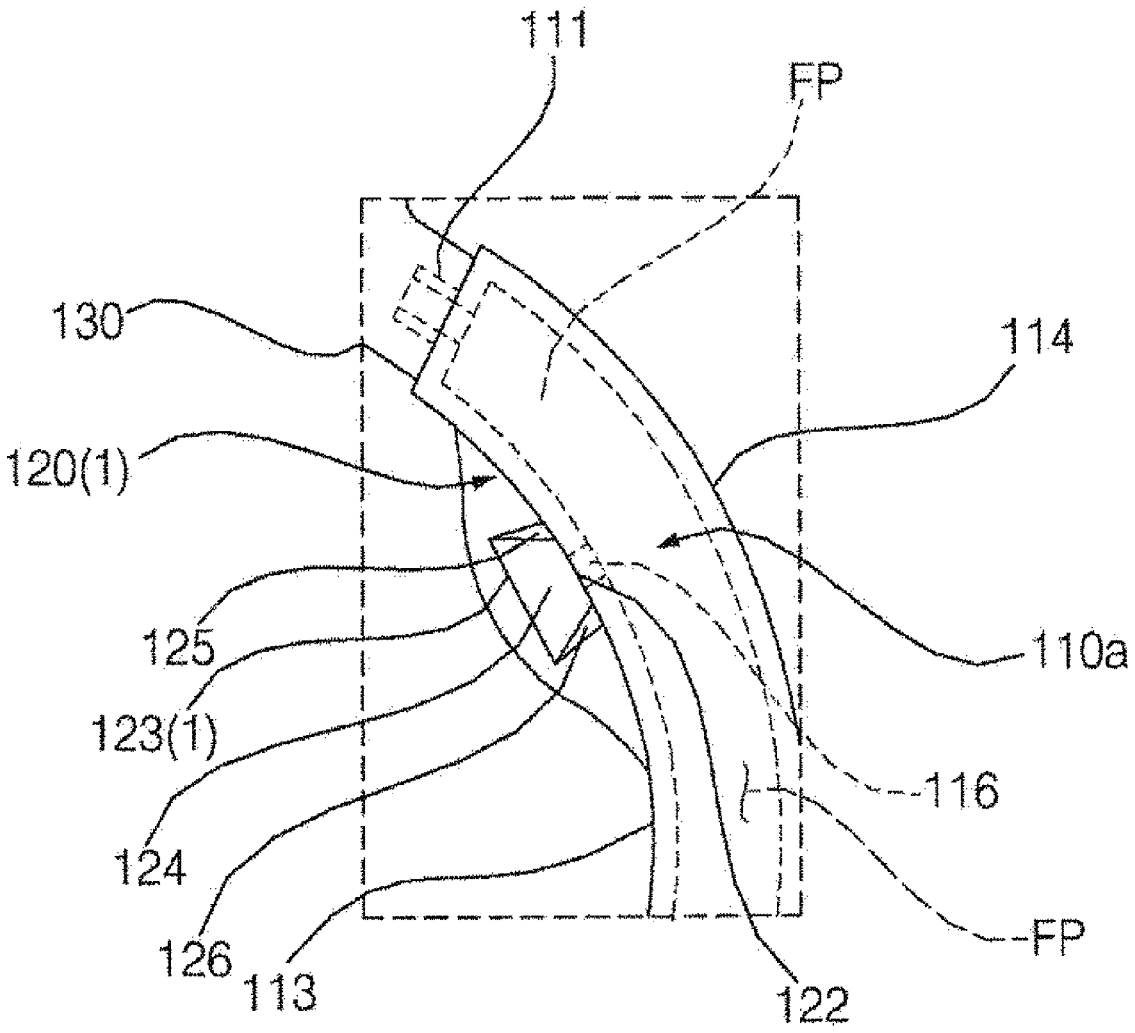
FIG. 6 shows a portion V of FIG. 5.
Figure 7:
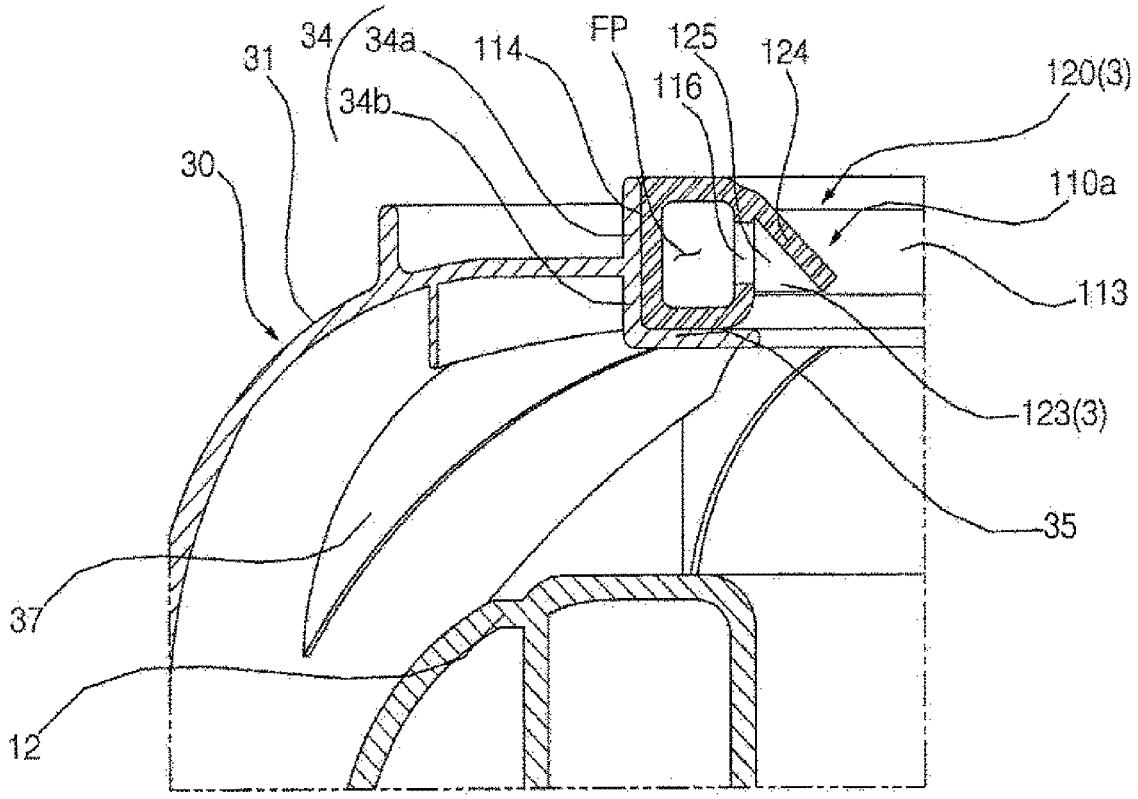
FIG. 7 shows a cross-sectional view taken along the line IV-IV of FIG. 4.
Figure 8:
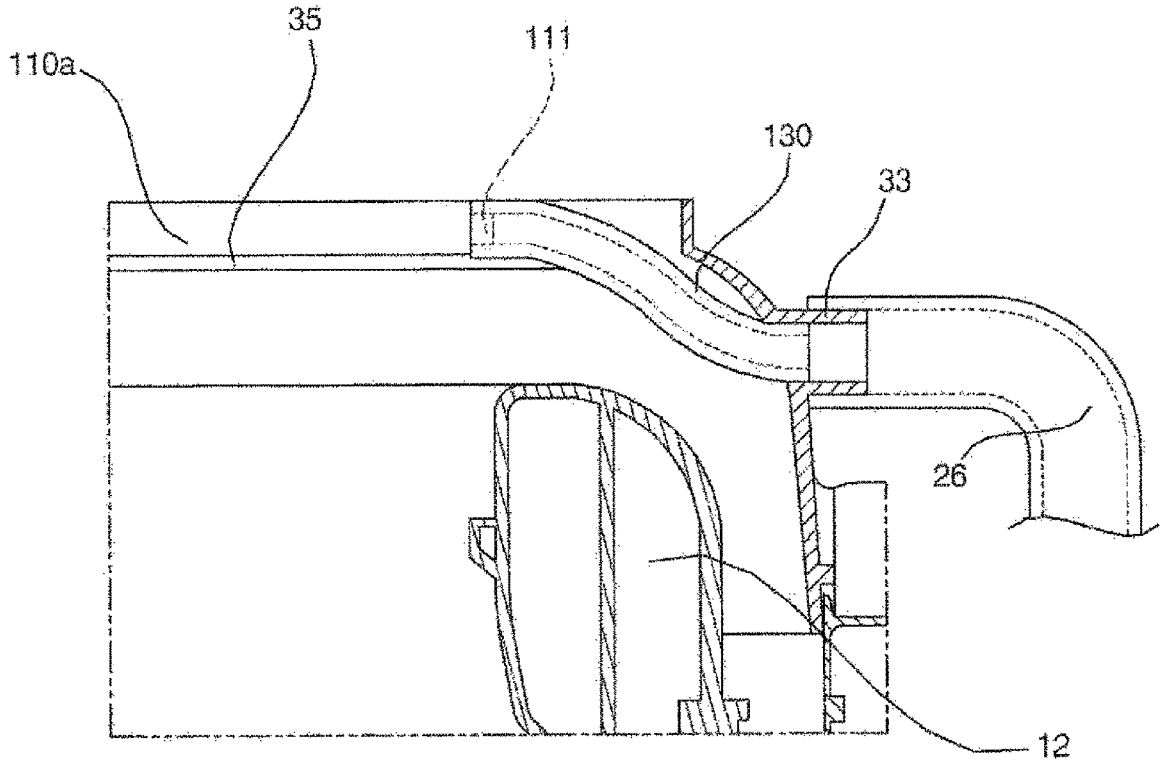
FIG. 8 shows an embodiment of a structure in which a spray mechanism and a circulation pipe are connected.

FIG. 1 is a perspective view of a washing machine according to an embodiment of the present invention. FIG. 2 is a cross-sectional side view taken along the line I-I of FIG. 1. FIG. 3 is a block diagram showing a control relationship between major components of a washing machine according to an embodiment of the present invention. FIG. 4 is a partial view of a washing machine according to an embodiment of the present invention. FIG. 5 shows a spray mechanism shown in FIG. 4. FIG. 6 shows a portion V of FIG. 5. FIG. 7 shows a cross-sectional view taken along the line IV-IV of FIG. 4. FIG. 8 shows an embodiment of a structure in which a spray mechanism and a circulation pipe are connected.

Referring to FIGS. 1 and 2, a cabinet 2 forms an outer shape of a washing machine and forms a space in which an outer tub 4 is accommodated. The cabinet 2 is supported by a flat base 5, and may include a top surface that is open, a front side, a left side, a right side, and a rear side.

A top cover 3 may be coupled to an open upper end of the cabinet 2. The top cover 3 may be provided with a loading port 3*h* for loading and unloading laundry (or "cloth"). A door 7 for opening and closing the loading port 3*h* may be rotatably coupled to the top cover 3.

The outer tub 4 is implemented to contain washing water, and may be suspended in the cabinet 2 by a support rod 15. The support rod 15 may be provided in four corners of the cabinet 2 respectively, one end of each support rod 15 pivotally connected to the top cover 3, and the other end thereof is connected to the outer tub 4 by a suspension 27.

Specifically, in the state of being fitted to the support rod 15, the suspension 27 may include a suspension cap 27*a* which is provided to be movable along the support rod 15 and a spring 27*b* which is fixed to the other end of the support rod 15 and elastically support the suspension cap 27*a*. The outer tub 4 is supported by the suspension cap 27*a*. Thus, when vibration of the outer tub 4 occurs, the suspension cap 27*a* together with the outer tub 4 is moved along the support rod 15, and the spring 27*b* is also deformed due to the displacement of the cap 27*a*.

The outer tub 4 may have an opened upper surface, and an outer tub cover 30 may be provided on the opened upper surface. The outer tub cover 30 is formed in a ring shape having an approximately circular opening 30*h* (see FIG. 4) formed in a center portion thereof, and laundry is loaded into an inner tub 6 through the opening 30*h*. The outer tub cover 30 may be made of a synthetic resin material.

In the outer tub 4, the inner tub 6 which accommodates laundry and is rotated about a vertical axis may be disposed. The inner tub 6 may be provided with a plurality of through holes through which water passes, and water may be exchanged between the inner tub 6 and the outer tub 4 through the through hole.

In the upper end of the inner tub 6, a balancer 12 for correcting the eccentricity caused when the inner tub 6 is rotated may be provided. The balancer 12 is provided with a fluid or a mass (or a rigid body) in an annular space provided along the upper end of the inner tub 6. When the inner tub 6 is biased to one side, the fluid or mass is moved to the opposite side so that eccentricity is automatically corrected.

A drain bellows 21 for discharging water from the outer tub 4 and a drain valve 22 for controlling the drain bellows 21 may be provided. The drain bellows 21 may be connected to the pump 24. When the drain valve 22 is opened, water may be supplied to a pump 24 through the drain bellows 21. The water inflowed into the pump 24 is discharged to the outside of the washing machine through a drain pipe 25 when the pump 24 is operated.

The pump 24 may selectively control the function of pumping the water discharged through the drain bellows 21 to the drain pipe 25 and the function of pumping the water to a circulation pipe 26 described later, under the control of the controller 17.

The pump 24 may include an impeller (not shown) for pumping water, a pump housing 24*d* in which the impeller is accommodated, and a pump motor 24*e* for rotating the impeller. The pump 24 may include an inflow port 24*a* which is connected to the bellows 21 and supplies water into the pump housing 24*d*, a drain discharge port 24*b* which is connected to the drain pipe 25, and discharges water, which is pumped by the impeller in the pump housing 24*d*, into the drain pipe 25, and a circulation water discharge port 24*c* which discharges water, which is pumped by the impeller in the pump housing 24*d*, into the circulation pipe 26.

The pump motor 24*e* may be capable of accomplishing a forward/reverse rotation. Depending on the direction in which the impeller rotates, water may be discharged through the drain discharge port 24*b* or water may be discharged through the circulation water discharge port 24*c*. Such a configuration can be implemented by appropriately designing the structure of the pump housing 24*d*. Since such a technology is already known in Korean Laid-Open Patent Publication No. 10-2013-0109354 and the like, a detailed description thereof will be omitted.

However, the present invention is not limited thereto, and a flow path switching valve (not shown) for selectively opening and closing the drain discharge port 24*b* and the circulation water discharge port 24*c* may be provided, under the control of the controller 17.

The inlet of the circulation pipe 26 is connected to the circulation water discharge port 24*c*, and the outlet is connected to a circulation water spray mechanisms 100*a*, 100*b*, 100*c* described later. However, it is not limited thereto, and a circulation pump for pumping water discharged from the outer tub 4 into the circulation pipe 26 and a drain pump for pumping water discharged from the outer tub 4 into the drain pipe 25 may be separately provided.

Preferably, the pump 24 (or the circulation pump) may be a pump capable of varying a speed (i.e., a variable speed pump). The pump 24 may include a variable speed pump motor 24*e* whose rotation speed is controlled. The pump motor 24*e* is preferably a brushless direct current motor, but is not necessarily limited thereto. A driver for speed control of the pump motor 24*e* may be further provided, and the driver may be an inverter driver. The inverter driver converts AC power into DC power to input to the motor at a target frequency, thereby controlling the pump motor 24*e* to rotate at a speed corresponding to the target frequency.

The controller 17 may include a Proportional-Integral Controller (PI controller), a Proportional-Integral-Derivative Controller (PID controller), and the like. The controller receives an output value (e.g., an output current) of the pump motor 24*e* as an input, and based on this, may control the driver so that the number of rotation (or rotation speed) of the pump motor 24*e* may follow a preset target number of rotation (or, target rotation speed).

The controller 17 changes the speed of the pump 24 so that the laundry may be soaked in an optimal manner in consideration of the state (e.g., loading height, position change, amount of laundry, etc.) of the laundry loaded into the inner tub 6.

Meanwhile, the controller 17 can control not only the pump motor 24*e* but also the overall operation of the washing machine, and it will be understood that the control of respective components mentioned below is performed by the control of the controller 17.

A pulsator 9 may be rotatably provided in the inner lower portion of the inner tub 6. The pulsator 9 may include a plurality of radial ribs protruding upwards. When the pulsator 9 is rotated, water flow may be formed by the ribs.

A drive unit 8 for providing power for rotating the inner tub 6 and the pulsator 9 may be disposed in the cabinet 2. The drive unit 8 may be disposed below the outer tub 4 and may be provided in the form of hanging in the cabinet 2 together with the outer tub 4. The rotation shaft of the drive unit 8 is always coupled to the pulsator 9, and may be coupled to or released from the inner tub 6 according to a switching operation of a clutch (not shown).

Therefore, when the drive unit 8 is operated while the rotation shaft of the drive unit 8 is coupled with the inner tub 6, the pulsator 9 and the inner tub 6 are integrally rotated. When the drive unit 8 is operated while the rotation shaft of the drive unit 8 is separated from the inner tub 6, only the pulsator 9 is rotated in the state where the inner tub 6 is stopped.

The drive unit 8 may include a washing motor capable of controlling a speed. The washing motor is preferably a brushless direct current motor (BLDC), but is not necessarily limited thereto.

The washing machine may include at least one water supply pipe 11 for guiding water supplied from an external water source such as a faucet. The at least one water supply pipe 11 may include a cold water pipe (not shown) receiving cold water from the external water source, and a hot water pipe (not shown) receiving hot water.

A water supply unit 13 for controlling the at least one water supply pipe 11 to be selectively opened and closed may be provided. The water supply unit 13 may include at least one water supply valve. When the at least one water supply valve is opened under the control of the controller 17, water is supplied to the dispenser 16 through the water supply pipe corresponding to the opened water supply valve.

The dispenser 16 supplies additives acting on the laundry together with the water into the inner tub 6. Additives supplied by the dispenser 16 include detergent for laundry and fabric softener for rinsing. The dispenser 16 may include a drawer 16*a* in which additive is accommodated, and a drawer housing 16*b* in which the drawer 16*a* is retractably received. A detergent accommodation unit (not shown) in which detergent for laundry is accommodated, and a softener accommodation unit (not shown) in which the fabric softener is accommodated may be partitioned in the drawer 16*a*.

When water is supplied to the detergent accommodation unit by the water supply unit 13, the supplied water is supplied to the inner tub 6 together with the detergent, and when the water is supplied to the fabric softener accommodation unit, the supplied water is supplied to the inner tub 6 together with the fabric softener. After water is supplied into the detergent accommodation unit or the fabric softener accommodation unit by the water supply unit 13, the detergent or the fabric softener does not exist any longer in the accommodation unit which achieved the water supply. Therefore, when water is supplied again later, the raw water supplied through the water supply unit 13 is supplied into the outer tub 4 intactly via the dispenser 16.

Referring to FIGS. 1 to 8, the washing machine according to an embodiment of the present invention includes a spray mechanism 100*a* for spraying water guided through the circulation pipe 26 into the inner tub 6. The spray mechanism 100*a* may be fixed to the outer tub cover 30.

The spray mechanism 100*a* may include a guide pipe 110*a* which is connected to the circulation pipe 26 and forms a guide flow path FP that guides water supplied from the circulation pipe 26 along the opening 30*h* formed in the outer tub cover 30, and a plurality of nozzles 120(1), 120(2), 120(3), 120(4), 120(5) which are disposed along the guide flow path FP and spray the water supplied from the guide pipe 110*a* into the inner tub 6

The circulation pipe 26 may be made of a flexible or deformable material. For example, the material may be rubber or synthetic resin, but is not limited thereto.

The guide pipe 110*a* may be formed in the form of a circular arc which is extended from a first end 111 (see FIG. 6) to a second end 112 (see FIG. 5) along the circumference of the opening 30*h* formed in the outer tub cover 30. The first end 111 is an open end and forms a port (hereinafter, also referred to as a "guide pipe port") connected to a connection pipe 130, and the second end 112 is closed. The guide pipe 110*a* (the same as the guide pipe of 110*b*, 110*c* described later) may be made of a synthetic resin material.

The connection pipe 130 may be made of a flexible or deformable material and, for example, the material is preferably rubber or synthetic resin, but is not limited thereto.

Referring to FIGS. 5 and 6, when the guide pipe 110*a* is viewed from the front, the guide flow path FP is extended in a ring or arc shape. As shown in FIG. 6, the radial width of the guide flow path FL is defined by two curved portions 113, 114 having concentricity. Hereinafter, one which is positioned inside among the two curved portions 113 and 114 is referred to as an inner diameter portion 113, and one which is positioned outside among the two curved portions 113 and 114 is referred to as an outer diameter portion 114.

Each of the nozzles 120(1), 120(2), 120(3), 120(4), and 120(5) may be configured in the form of protruding from the inner diameter portion 113 of the guide pipe 110*a*. The plurality of nozzles 120(1), 120(2), 120(3), 120(4), and 120(5) are preferably disposed at equal intervals, but are not necessarily limited thereto.

In the inner diameter portion 113 of the guide pipe 110*a*, nozzle communication holes 116 which communicate the guide flow path FP to an inlet 122 of each of the nozzles 120(1), 120(2), 120(3), 120(4), and 120(5) may be formed. The inlet 122 of the nozzle may be positioned in the inner diameter portion 113 of the guide pipe 110*a*. The nozzle 120(1), 120(2), 120(3), 120(4), 120(5) may include a collision surface 124 extended from the inner diameter portion 113, a first side surface 125, and a second side surface 126. In each of the nozzle 120(1), 120(2), 120(3), 120(4), and 120(5), an area recessed from an outlet 123(1), 123(2), 123(3), 123(4), 123 (5) is formed by the inner circumferential surface (the surface on the inner diameter portion 113) of the guide pipe 110*a*, the collision surface 124, the first side surface 125, and the second side surface 126.

The collision surface 124 defines an angle formed by the water sprayed from the nozzle 120(1), 120(2), 120(3), 120(4), 120(5) with respect to horizon, and is inclined so that the water discharged from the inlet 122 of the nozzle 120(1), 120(2), 120(3), 120(4), 120(5) is bent downwardly. The first side 125 and the second side 126 define the width of the water sprayed from the nozzle 120(1), 120(2), 120(3), 120(4), 120(5) respectively, and define one side and the other side of the width respectively. For reference, FIG. 6 shows only the nozzle 120(1), but other nozzles 120(2), 120(3), 120(4), and 120(5) may also be substantially identically configured.

Referring to FIGS. 4 and 7, the outer tub cover 30 may include a cover ring 31 of a ring shape having an outer diameter portion coupled with the outer tub 4, and a rim 34 which is extended in the form of a circular arc along an inner diameter portion of the cover ring 31 and defines at least a portion of the opening 30*h*. In addition, the outer tub cover 30 may further include a support rib 35 having a circular arc shape that protrudes horizontally from the inner circumferential surface of the rim 34 facing the opening 30*h* and is extended along the circumferential direction.

The rim 34 may include an upper rim 34*a* protruding upward from the cover ring 31, and a lower rim 34*b* protruding downward from the cover ring 31, and the support rib 35 may protrude from the lower rim 34*b*.

The guide pipe 110*a* may be seated on the support rib 35. At this time, the outer diameter portion 114 of the guide pipe 110*a* is in contact with the rim 34. Since the guide pipe 110*a* is fitted in an area defined by the rim 34, it can be maintained in place without shaking even during operation of the washing machine.

The guide pipe 110*a* may be coupled to at least one of the rim 34 and the support rib 35 by welding. However, it is not limited thereto, and coupling using a fastening means such as a screw or a bolt is possible, and alternatively, bonding using an adhesive is also possible.

Referring to FIGS. 4 and 8, the outer tub cover 30 may further include a circulation pipe connection port 33 protruding from the outer surface of the cover ring 31. The circulation pipe 26 may be connected to the inlet of the circulation pipe connection port 33, and the connection pipe 130 may be connected to the outlet of the circulation pipe connection port 33.

The outlet of the circulation pipe connection port 33 may be positioned in the inner surface of the cover ring 31, and the connection pipe 130 may be inserted into the outlet of the circulation pipe connection port 33. A fastening member (not shown) for fixing the connection pipe 130 to the inner surface of the cover ring 31 may be provided so that the connection pipe 130 is not separated from the circulation pipe connection port 33.

The circulation pipe connection port 33 may be inserted into the circulation pipe 26, and a clamp (not shown) for tightening the outer circumferential surface of the circulation pipe 26 (particularly, the portion where the circulation pipe connection port 33 and the circulation pipe 26 are overlapped) may be further provided so that the circulation pipe 26 is not separated from the circulation pipe connection port 33.

Referring to FIG. 4, the outer tub cover 30 may further include a grill 32 formed in the inner side surrounded by the cover ring 31. The grill 32 is positioned below the dispenser 16, and furthermore is positioned between the first end 111 and the second end 112 of the guide pipe 110*a* when the washing machine is viewed from the front. The water discharged from the dispenser 16 passes through the grill 32 and is supplied to the inner tub 6.

Figure 9:
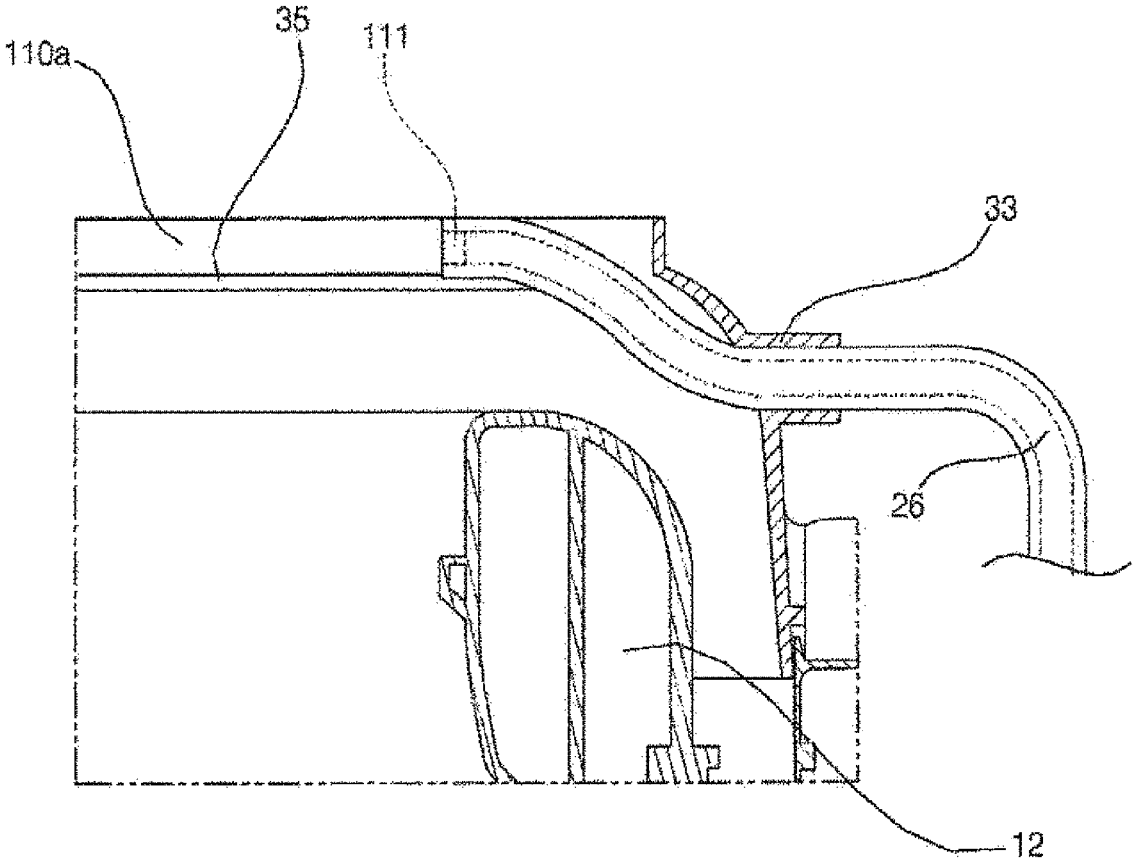
FIG. 9 shows another embodiment of a structure in which a spray mechanism and a circulation pipe are connected.

FIG. 9 shows another embodiment of a structure in which a spray mechanism and a circulation pipe are connected. Referring to FIG. 9, the circulation pipe 26 may be connected to a second port (or guide pipe port 111) formed in the guide pipe 110*a* through a first port 33 (in the above embodiment, a configuration referred to as the "circulation pipe connection port", but in the present embodiment, referred to as a "first port") formed in the outer tub cover 30. Since the connection pipe 130 (see FIG. 8) is not necessary, the flow path is simplified. In particular, it is enough that only the circulation pipe 26 fitted into the second port 111 is fixed by using a clamp (not shown), there is an effect that the number of necessary clamps can be reduced and the number of assembly processes in the manufacturing process can be reduced.

Figure 10:
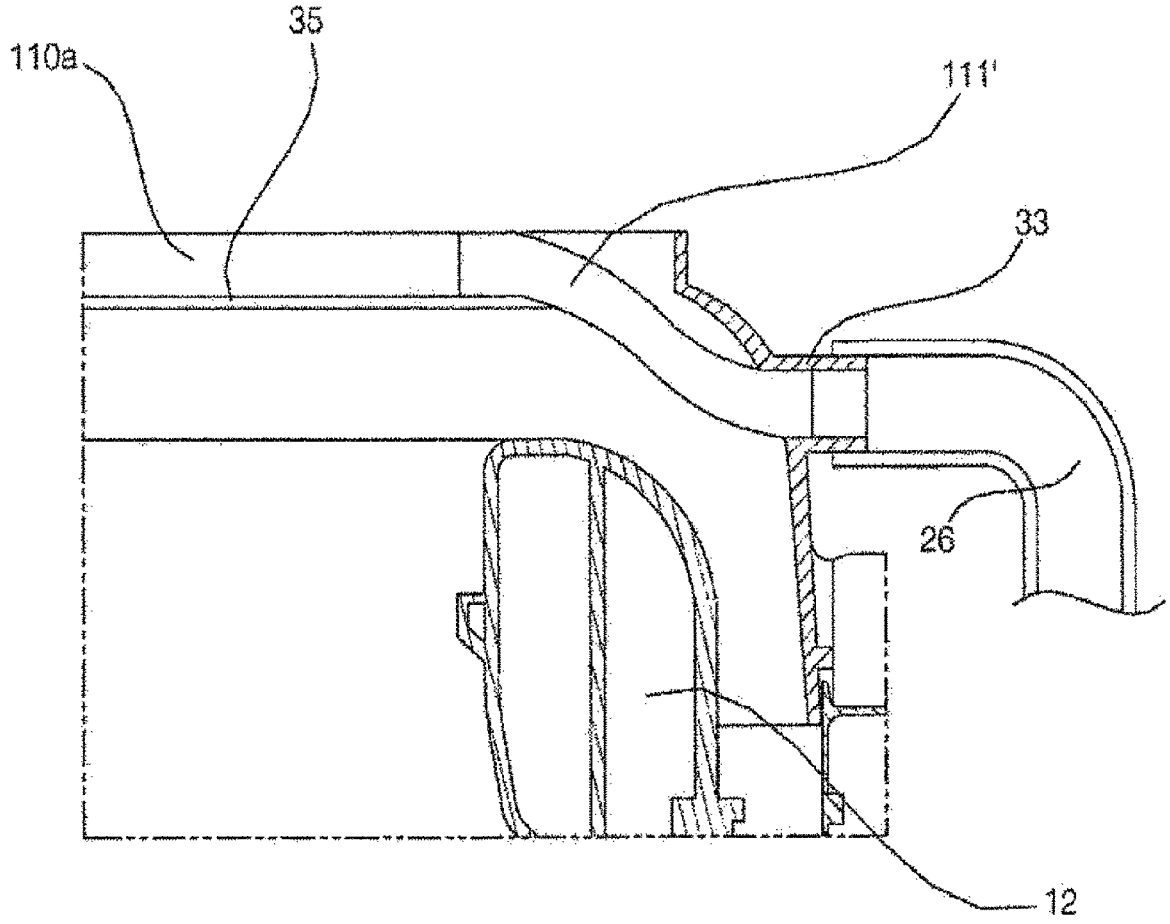
FIG. 10 shows another embodiment of a structure in which a spray mechanism and a circulation pipe are connected.

FIG. 10 shows another embodiment of a structure in which a spray mechanism and a circulation pipe are connected. Referring to FIG. 10, the flow path connection between the circulation pipe 26 and the guide pipe 110*a* may be achieved by inserting the guide pipe port 111' protruding from the guide pipe 1100 into the circulation pipe connection port 33. The guide pipe 110*a* and the circulation pipe 26 may be flow-path connected in a simple manner that the guide pipe port 111' is inserted into the outlet of the circulation pipe connection port 33 and the circulation pipe 26 is inserted into the inlet of the circulation pipe connection port 33.

Figure 11:
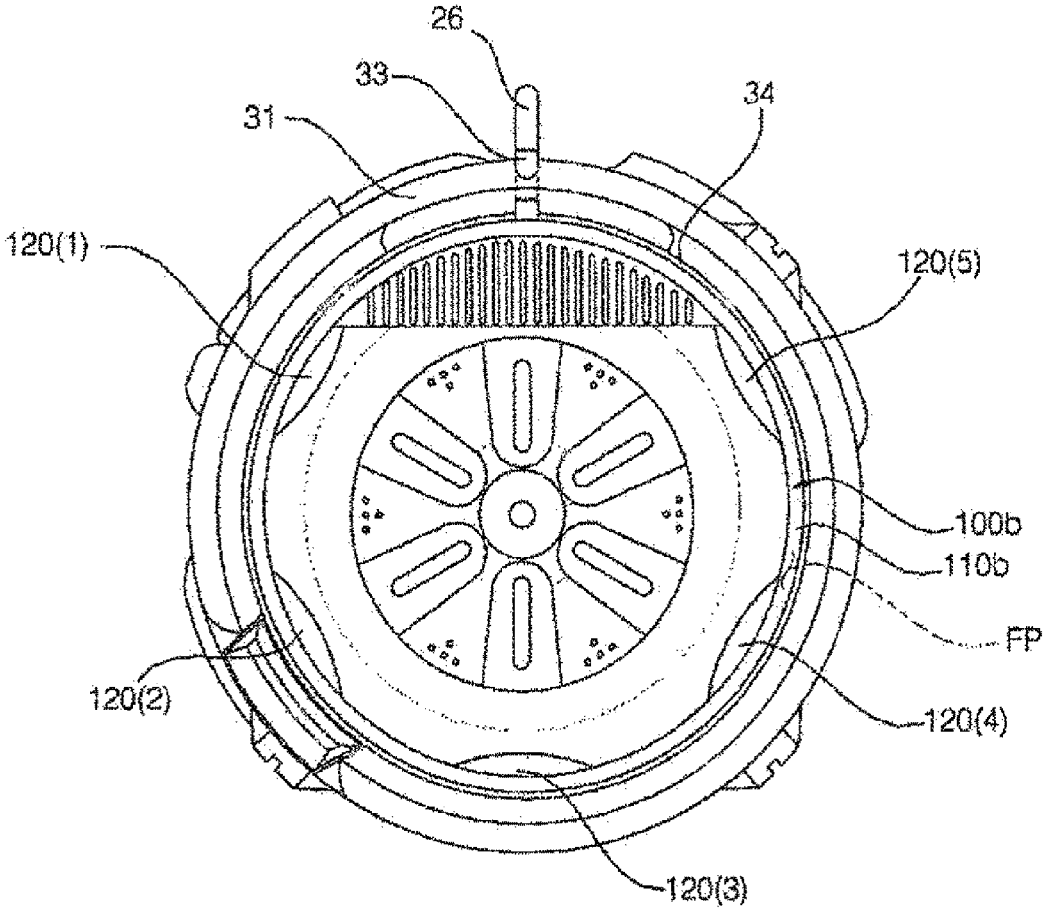
FIG. 11 is a partial view of a washing machine according to another embodiment of the present invention.
Figure 12:
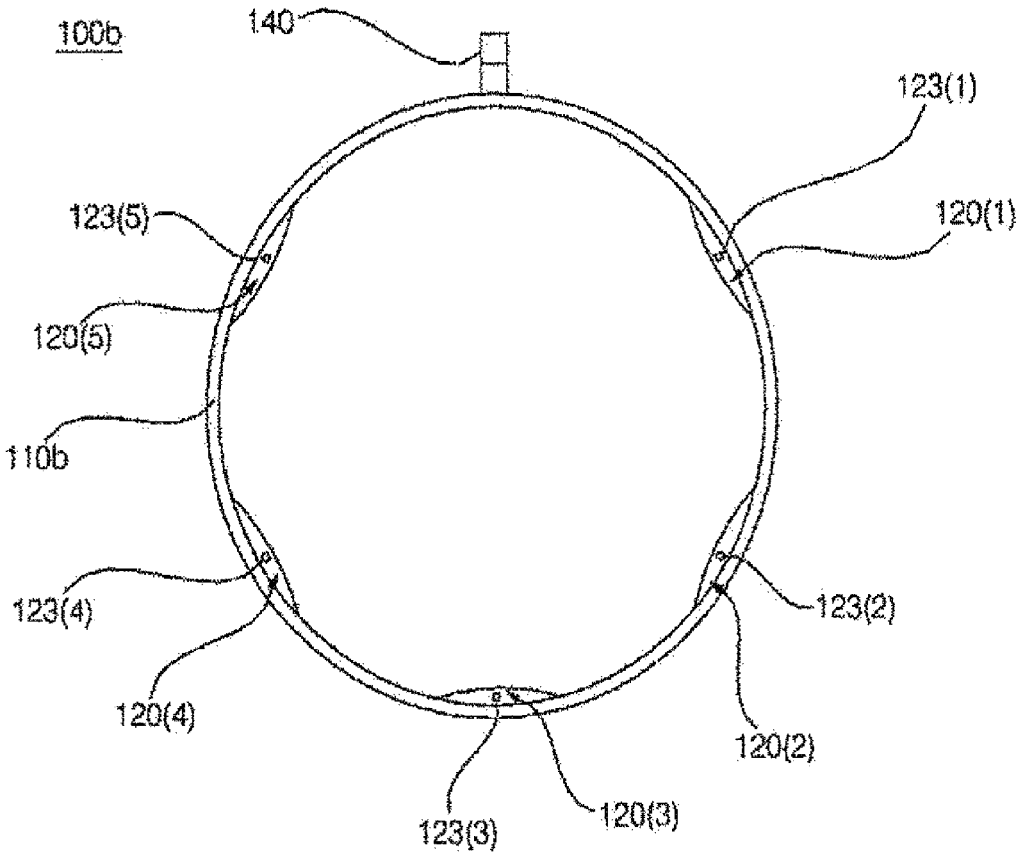
FIG. 12 shows a spray mechanism shown in FIG. 11.

FIG. 11 is a partial view of a washing machine according to another embodiment of the present invention. FIG. 12 shows a spray mechanism shown in FIG. 11. Referring to FIGS. 11 to 12, the spray mechanism 100*b* may include an annular (or circular) guide pipe 110*b*. An annular guide flow path FP is formed by the annular guide pipe 110*b*, and a plurality of nozzles 120(1), 120(2), 120(3), 120(4), and 120(5) are disposed along the guide flow path FP.

The guide pipe port 140 may be extended from the outer circumferential surface of the guide pipe 110*b*. One end of the guide pipe port 140 is in communication with the guide flow path FP, and the other end is flow-path connected to the circulation pipe 26. The flow path connection between the guide pipe port 140 and the circulation pipe 26 according to any of the above-described embodiments with reference to FIGS. 8 to 10 will do. The water pumped by the pump 24 flows along the circulation pipe 26 and flows into the guide pipe port 140, and, in this process, may pass through the connection pipe 130 (see FIG. 8) depending on the embodiment.

The water passed through the guide pipe port 140 is branched to both sides to fill a circular (or annular) guide flow path FP. Since the circular guide flow path FP has no place where the flow is stagnant, no residual water remains in the flow path and most of the water is discharged through the nozzles 120(1), 120(2), 120(3), 120(4), and 120(5). Therefore, as much, the contamination due to the blockage of the guide flow path FP, the water scale, or the detergent residues is prevented.

Meanwhile, in the embodiment described above, the manner in which the guide pipe 110*b* is installed in the outer tub cover 30 can be achieved in substantially the same manner as in the embodiment described above with reference to FIG. 7.

Figure 13:
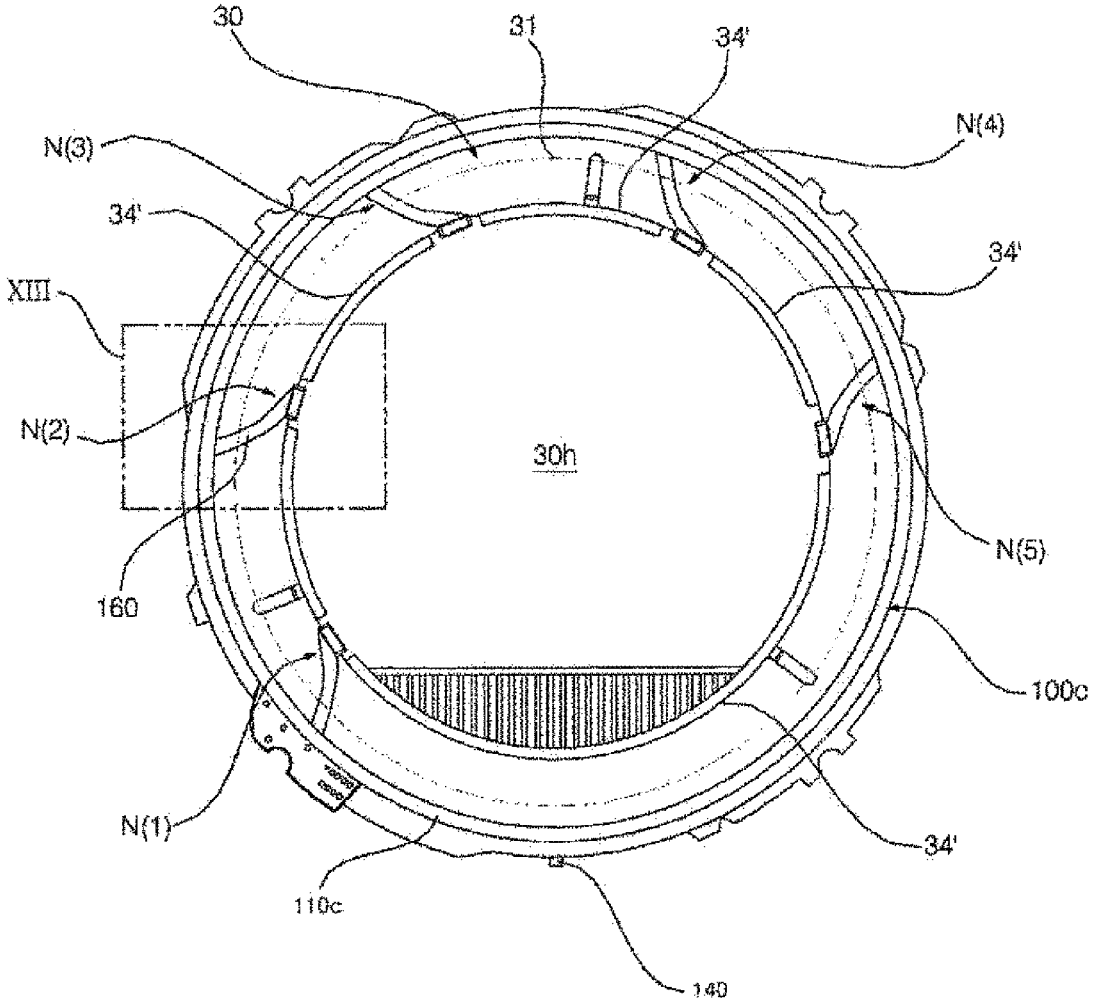
FIG. 13 is a partial view of a washing machine according to another embodiment of the present invention.
Figure 14:
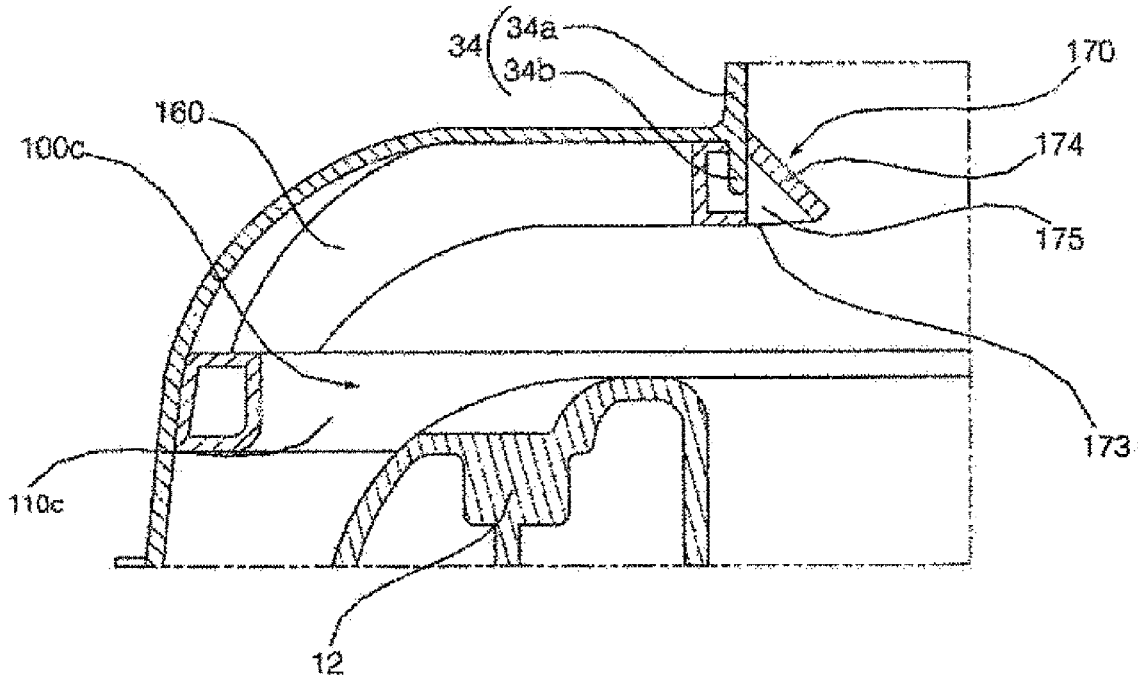
FIG. 14 shows a cross section taken from a portion XIII of FIG. 13.
Figure 15:
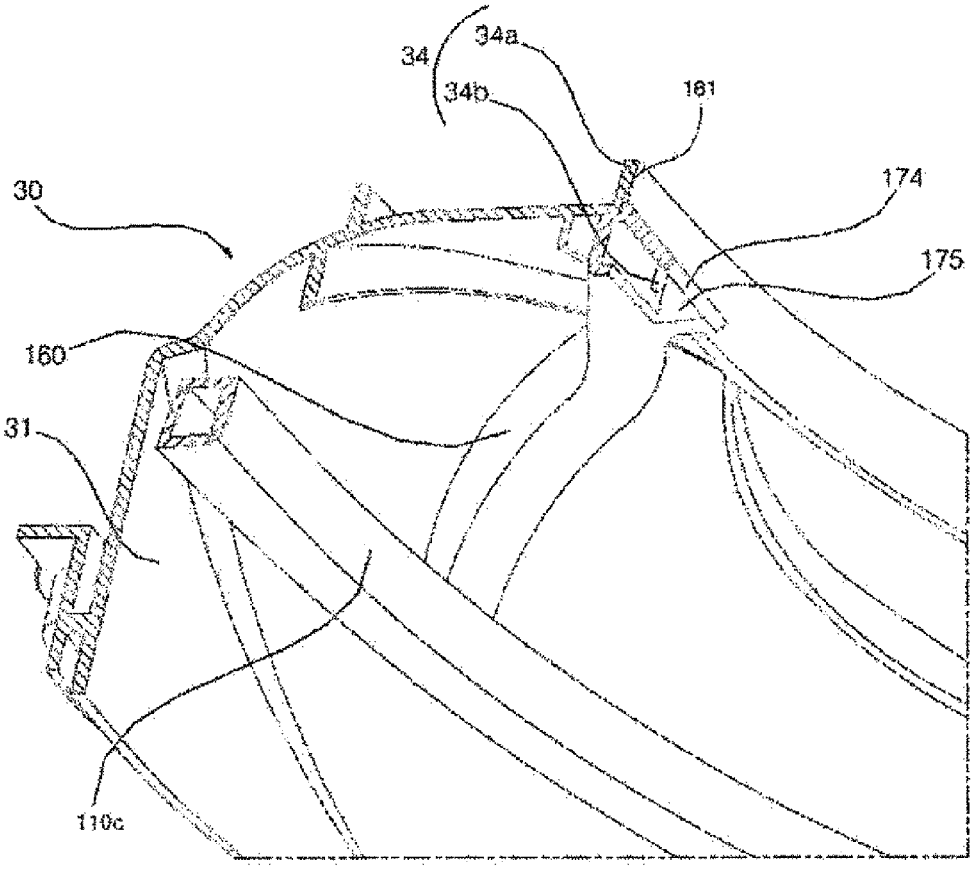
FIG. 15 is a perspective view of FIG. 14.
Figure 16:
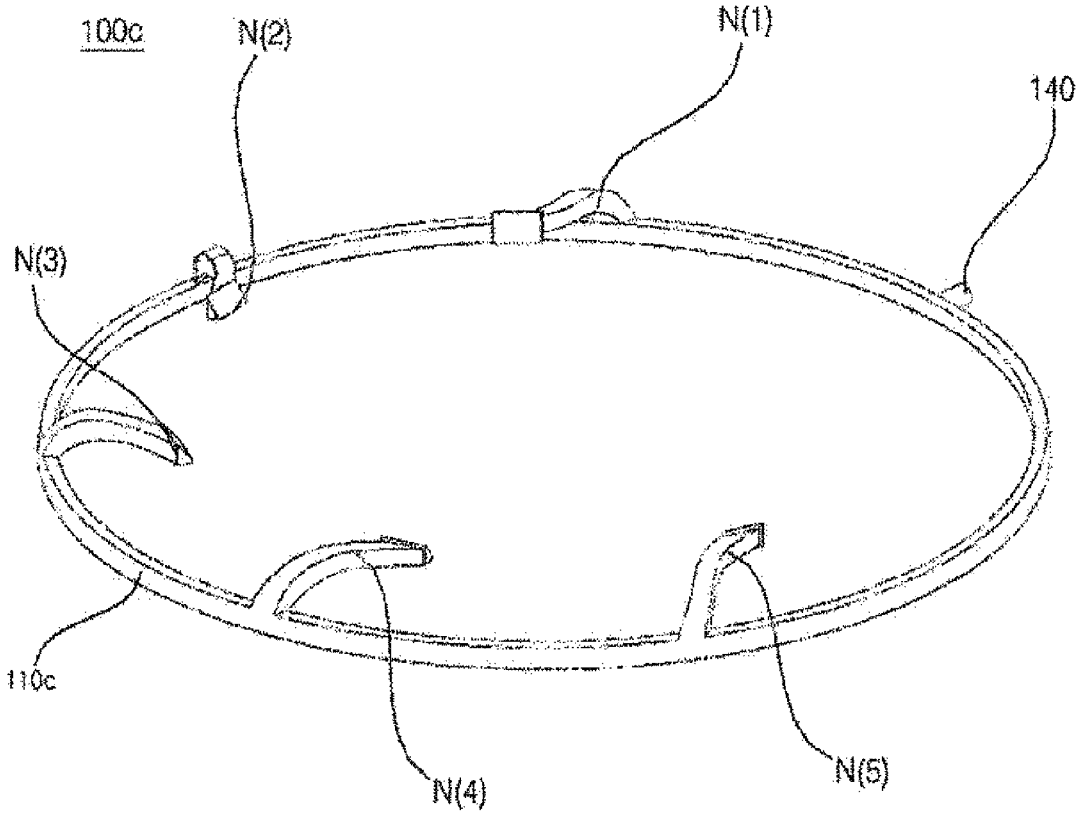
FIG. 16 shows a spray mechanism shown in FIG. 13.
Figure 17:
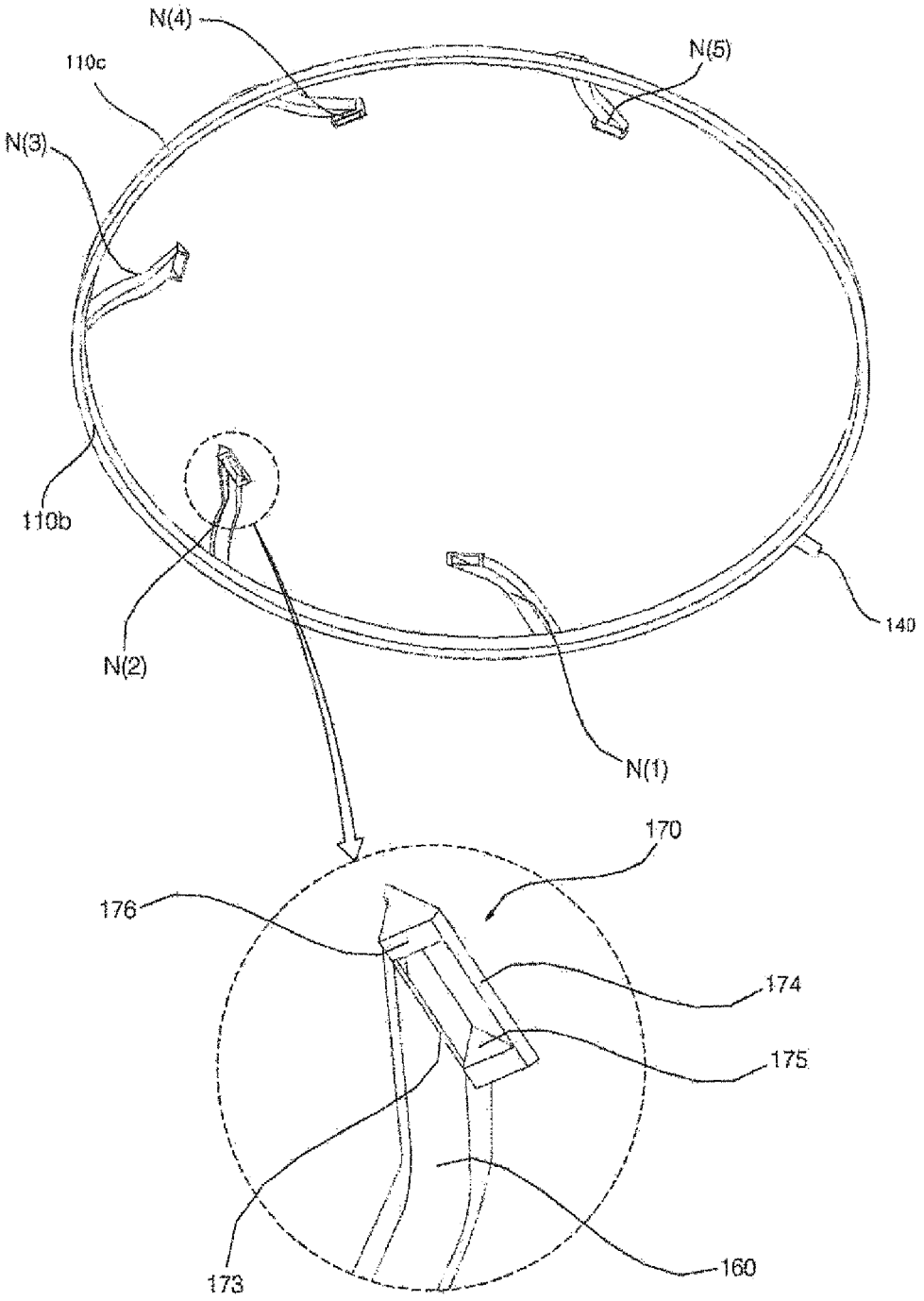
FIG. 17 shows the spray mechanism shown in FIG. 16 viewed from below.

FIG. 13 is a partial view of a washing machine according to another embodiment of the present invention. FIG. 14 shows a cross section taken from a portion XIII of FIG. 13. FIG. 15 is a perspective view of FIG. 14. FIG. 16 shows a spray mechanism shown in FIG. 13. FIG. 17 shows the spray mechanism shown in FIG. 16 viewed from below.

Referring to FIGS. 13 to 17, the spray mechanism 100*c* includes a guide pipe 110*c* and a plurality of nozzle modules N(1), N(2), N(3), N(4), and N(5) extended from the guide pipe 110*c*.

Each nozzle module N(1), N(2), N(3), N(4), N(5) includes a nozzle connection pipe 160 extended along the bottom surface of the cover ring 31 toward the opening 30*h*, and a nozzle 170 which is connected to the nozzle connection pipe 160 and sprays water supplied from the nozzle connection pipe 160.

The nozzle connection pipe 160 may be extended diagonally from the guide pipe 110 at a certain angle with respect to a radial direction. When the inner tub 6 is rotated at an appropriate speed in consideration of the water level in the outer tub 4, the water in the outer tub 4 is raised along between the inner tub 6 and the outer tub 4 by centrifugal force, and is guided in the centrifugal direction along the bottom surface of the cover ring 31 and poured into the inner tub 6. At this time, the travel direction of the water flow flowing along the bottom surface of the cover ring 31 has a circumferential component. Since such a water flow is guided by the nozzle connection pipe 160 diagonally disposed in the bottom surface of the cover ring 31, the water flow in the bottom surface of the cover ring 31 can be further enhanced.

The nozzle 170 may include a collision surface 174 on which water supplied through the nozzle connection pipe 160 collides, a first side surface 175, and a second side surface 176. The collision surface 174 defines an angle formed by the water sprayed from the nozzle 170 with respect to horizon, and is inclined such that water is discharged downward from the outlet 173 of the nozzle 170.

The first side surface 175 and the second side surface 176 define the width of the water sprayed from the nozzle 170 respectively, and define one side and the other side of the width respectively.

A portion where each nozzle 170 and the nozzle connection pipe 160 are connected may form a step. At least a part of the nozzle 170 protrudes upward from the nozzle connection pipe 160, and a portion where such a protruded portion and the upper surface of the nozzle connection pipe 160 are connected may form a "L" shaped step 181 (see FIG. 15).

The outer tub cover 30 may include an upper rim 34*a* protruded upward from the inner diameter portion of the cover ring 31 and extended in the circumferential direction to define at least a portion of the opening 30*h*, and a plurality of lower rims 34*b* protruded downward from the inner diameter portion of the cover ring 31 from a portion corresponding to the upper rim 34*a* and extended along the circumferential direction.

In particular, each of the lower rims 34*b* is formed in the form of a circular arc, and adjacent ones may be spaced at certain intervals. The upper surface of the nozzle connection pipe 160 is positioned in the spaced portion (i.e., the bottom surface of the cover ring 31 in which the lower rims 34*b* is not formed), and the inner circumferential surface of the upper rim 34*a* corresponding to the spaced portion comes into contact with the nozzle 170. Meanwhile, the nozzle connection pipe 160 may be provided with a rim insertion hole (not shown, a hole through which the lower rim 34*b* is inserted into the nozzle connection pipe 160 in FIG. 14) through which the lower rim 34*b* passes. By rotating the spray mechanism 100*c*, one end of the lower rim 34*b* may be inserted into the rim insertion hole. The rim insertion hole may be formed in each nozzle 170. When the spray mechanism 100*c* is rotated, each lower rim 34*b* may be inserted into the rim insertion hole formed in the adjacent nozzle 170 simultaneously.

The guide pipe 110*c* may be coupled to the outer tub cover 30 by welding. However, it is not limited thereto, and coupling by using fastening means such as a screw or a bolt is also possible, and alternatively, bonding by using an adhesive is also possible.

The invention claimed is:

1. A washing machine comprising:

an outer tub defining an opening at an upper side;

an inner tub that is rotatably provided about a vertical axis in the outer tub;

an outer tub cover that is disposed at the upper side of the outer tub and that defines an opening for receiving laundry into the inner tub;

a circulation pipe that is configured to guide water discharged from the outer tub;

a pump that is configured to transfer water along the circulation pipe; and a spray mechanism that is disposed at the outer tub cover and that is configured to spray the water guided through the circulation pipe into the inner tub, wherein the spray mechanism comprises:

a guide pipe defining a guide flow path configured to guide the water supplied from the circulation pipe along a circumference of the opening, and a plurality of nozzles that are disposed along the guide flow path and that are configured to spray the water supplied through the guide pipe into the inner tub, wherein the guide pipe comprises:

an outer diameter portion that extends along a circumferential direction of the outer tub cover, and an inner diameter portion that is radially spaced inwardly from the outer diameter portion and that defines a nozzle communication hole facing the outer diameter portion in a horizontal direction, wherein the plurality of nozzles comprise:

an inlet that is in communication with the nozzle communication hole, a collision surface that extends from the inner diameter portion, that is inclined toward an inner space of the inner tub, and that faces the nozzle communication hole in the horizontal direction, and an outlet that is provided below the collision surface and that faces the collision surface in a vertical direction.

2. The washing machine of claim 1, wherein the outer diameter portion extends along an upper end of the outer tub cover that defines the opening, and wherein the inner diameter portion extends in parallel with the outer diameter portion, wherein the inlet of the plurality of nozzles is positioned at the inner diameter portion and faces the outer diameter portion in the horizontal direction.

3. The washing machine of claim 2, wherein the inlet of the plurality of nozzles faces the collision surface in the horizontal direction.

4. The washing machine of claim 1, wherein the outer tub cover comprises:

a cover ring that has a ring shape and that couples to an upper end of the outer tub;

a rim that extends along an inner diameter of the cover ring and that defines at least a portion of the opening; and a support rib that protrudes inwardly from the rim in a radial direction and that supports the guide pipe from below.

5. The washing machine of claim 1, wherein the guide pipe comprises:

a first end which communicates with the circulation pipe; and a blocked second end which is progressed and reached along the guide flow path from the first end.

6. The washing machine of claim 1, wherein the guide flow path is annular.

7. The washing machine of claim 5, wherein the spray mechanism comprises (i) a guide pipe port that protrudes outward from the guide pipe in a radial direction and (ii) a flow-path that connects the circulation pipe and the guide pipe.

8. The washing machine of claim 7, wherein the circulation pipe is connected to the guide pipe port through the outer tub cover.

9. The washing machine of claim 7, wherein the outer tub cover comprises:

a cover ring that has a ring shape and that couples to an upper end of the outer tub; and a connection port that protrudes outward from the cover ring in a radial direction and that is in communication with an inside and an outside of the cover ring, wherein the circulation pipe is connected to the connection port in the outside of the cover ring, and wherein the spray mechanism further comprises a connection pipe for connecting the guide pipe and the connection port in the inside of the cover ring.

10. The washing machine of claim 1, wherein the outer tub cover comprises:

a cover ring that has a ring shape and that couples to an upper end of the outer tub; and a connection port that protrudes outward from the cover ring in a radial direction and that is in communication with an inside and an outside of the cover ring, wherein the spray mechanism further comprises a guide pipe port that protrudes outward from the guide pipe in a radial direction and that is connected to the connection port.

11. The washing machine of claim 1, wherein the spray mechanism further comprises a plurality of nozzle connection pipes that correspond to the plurality of nozzles and that respectively extend inward along a radial direction from the guide pipe to guide the water to a corresponding nozzle.

12. The washing machine of claim 11, wherein each of the nozzle connection pipes is disposed in a bottom surface of the outer tub cover.

13. The washing machine of claim 12, wherein the nozzle connection pipe is gradually deflected in a circumferential direction as it progresses toward the nozzle from the guide pipe.

14. The washing machine of claim 13, wherein the outer tub cover comprises a lower rim that protrudes downward from a circumference of the opening and that extends along the circumference of the opening, wherein the nozzle connection pipe is provided with a rim insertion hole into which the lower rim is inserted.

15. The washing machine of claim 1, wherein the pump is a variable speed pump.

* * * * *